US005572841A

United States Patent [19]

Buster

[11] Patent Number: 5,572,841

[45] Date of Patent: Nov. 12, 1996

[54] MODULAR WALL PANEL ASSEMBLY

[76] Inventor: Robert W. Buster, 812 E. 4th Ave., Big Timber, Mont. 59011

[21] Appl. No.: 419,433

[22] Filed: Apr. 10, 1995

[51] Int. Cl.[6] ..... E04B 1/02

[52] U.S. Cl. ..... 52/270; 52/243.3; 52/93.2; 52/266; 52/271; 52/295

[58] Field of Search ..... 52/293.3, 295, 52/D9, 61, 93.1, 93.2, 220.3, 221, 266, 270, 271

[56] References Cited

U.S. PATENT DOCUMENTS

| | | | |
|---|---|---|---|
| 575,209 | 1/1897 | Bruckner . | |
| 1,349,850 | 8/1920 | Patterson | 52/265 X |
| 1,986,690 | 1/1935 | Thomson | 52/266 X |
| 2,348,180 | 5/1944 | Paley | 52/93.2 X |
| 2,811,850 | 11/1957 | Clary | 52/220.3 X |
| 3,601,942 | 8/1971 | Wilson | 52/293.3 X |
| 3,683,569 | 8/1972 | Holm | 52/93.1 |
| 3,826,052 | 7/1974 | Tenorio . | |
| 4,435,929 | 3/1984 | Bussell | 52/93.1 |
| 4,694,624 | 9/1987 | Juhas | 52/270 X |
| 4,811,536 | 3/1989 | Hardt . | |
| 5,154,029 | 10/1992 | Sturgeon | 52/61 X |
| 5,327,699 | 7/1994 | Khan et al. | 52/93.2 |
| 5,339,592 | 8/1994 | Schmid . | |

FOREIGN PATENT DOCUMENTS

| | | | |
|---|---|---|---|
| 992318 | of 1951 | France | 52/270 |
| 1086226 | 5/1966 | United Kingdom | 52/61 |

*Primary Examiner*—Wynn E. Wood
*Assistant Examiner*—Aimee E. McTigue
*Attorney, Agent, or Firm*—Michael I. Kroll

[57] ABSTRACT

A modular wall panel assembly comprising a plurality of generally rectangular shaped elongated horizontal slabs. Each slab has a series of vertical through-going apertures, a sloping outwardly front surface and a vertical rear surface. A plurality of wallboards are provided with each wallboard secured to the rear surface of each slab. Each wallboard will overhang a bottom end and a rear end of each slab and will be set back from a top end and a front end of each slab. A plurality of siding sheets are also provided, with each siding sheet secured to the front surface of each slab. Each siding sheet will overhang the bottom end and the rear end of each slab and will be set back from the front end of each slab. The slabs can be interconnected one upon the other and side by side, with the through-going apertures in the slabs above in alignment with the through-going apertures in the slabs below. The wallboards abut each other and the siding sheets overlap each other.

14 Claims, 2 Drawing Sheets

MODULAR WALL PANEL ASSEMBLY

BACKGROUND OF THE INVENTION

1. Field of the Invention

The instant invention relates generally to wall building products and more specifically it relates to a modular wall panel assembly.

2. Description of the Prior Art

Numerous wall building products have been provided in prior art. For example, U.S. Pat. No. 575,209 to Bruckner; U.S. Pat. No. 3,826,052 to Tenorio; U.S. Pat. No. 4,811,536 to Hardt and U.S. Pat. No. 5,339,592 to Schmid all are illustrative of such prior art. While these units may be suitable for the particular purpose to which they address, they would not be as suitable for the purposes of the present invention as heretofore described.

BRUCKNER, ALFRED

HOLLOW PLATE WALL

U.S. Pat. No. 575,209

A wall composed of hollow plates or slabs each having a series of through-going channels and a series of channels partially extending through, as specified. The through-going channels of the one slab corresponds with those of the adjacent slab. Metal stays extend through the through-going channels. A means is for attaching same to the floor and ceiling. A binding material is arranged in the channels around the stays substantially as described.

TENORIO, CARLOS A.

COMPOSITE WALL PANEL FOR BUILDING CONSTRUCTION

U.S. Pat. No. 3,826,052

A wall panel comprising an uptight core of plastic insulating material with skins overlying opposed faces of the core and extending beyond its top edge to form a continuous upper trough. Sets of generally vertical grooves extend from the continuous upper trough adjacent the skins to the bottom of the core. Additional sets of passages interconnect with the vertical passages to form a network of passages. The passages and open trough are filled with concrete to form a continuous upper beam supported by an integral open web type of construction. Panels may be placed end to end to form a perimeter and other walls of a building.

HARDT, WILLIAM G.

OUTER WALL STRUCTURE FOR BUILDINGS

U.S. Pat. No. 4,811,536

A building, the outer walls of which are formed of prefabricated panels of cementitious material having hollow sections extending substantially continuously throughout the height of the panels in closely spaced apart relation. A footing is adapted to enable the panels to be mounted thereon. A means is for securing the panels onto the footing, and to each other, to provide a strong, sturdy and inexpensive assembly of outer building walls.

SCHMID, DONALD T.

INSULATED BUILDING BLOCKS AND COMPOSITE WALLS HAVING STACKABLE HALF-BOND SYMMETRY

U.S. Pat. No. 5,339,592

An insulated building block having stackable half-bond symmetry. The block has a pair of block parts the inner surfaces of which are serpentine-shaped defined by overlapping projections alternately from the block parts. Insulation is sandwiched between the block parts. The projections have enlarged end portions for interlocking the insulation to the block parts. The portion of the serpentine pattern in one of the block halves, defined by a plane parallel to the end walls and midway therebetween, is a repeat of the portion of the serpentine pattern in the other of the block halves such that the blocks are stackable in a staggered half bond relation with alignment of the insulation in the stacked block halves. At least two pins on different axes each extending longitudinally of the block into at least one projection of each block part. For bonding the insulation to the block parts, bonding material is injected into at least one cavity in the insulation in contact with both the insulation and at least one of the block parts. A composite wall comprises such building block parts stacked in half-bond symmetry, a poured concrete sheet, and insulation material having the serpentine pattern between the block parts and the concrete sheet.

SUMMARY OF THE INVENTION

A primary object of the present invention is to provide a modular wall panel assembly that will overcome the shortcomings of the prior art devices.

Another object is to provide a modular wall panel assembly that is mainly fabricated out of paper and cardboard wastes, thereby reducing the amount of new lumber needed in building construction.

An additional object is to provide a modular wall panel assembly that will combine at least five different on site construction steps into one, such as framing, sheeting, siding, insulation and plastering, in which walls will be finished in the time it normally takes to frame the walls.

A further object is to provide a modular wall panel assembly that is simple and easy to use.

A still further object is to provide a modular wall panel assembly that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
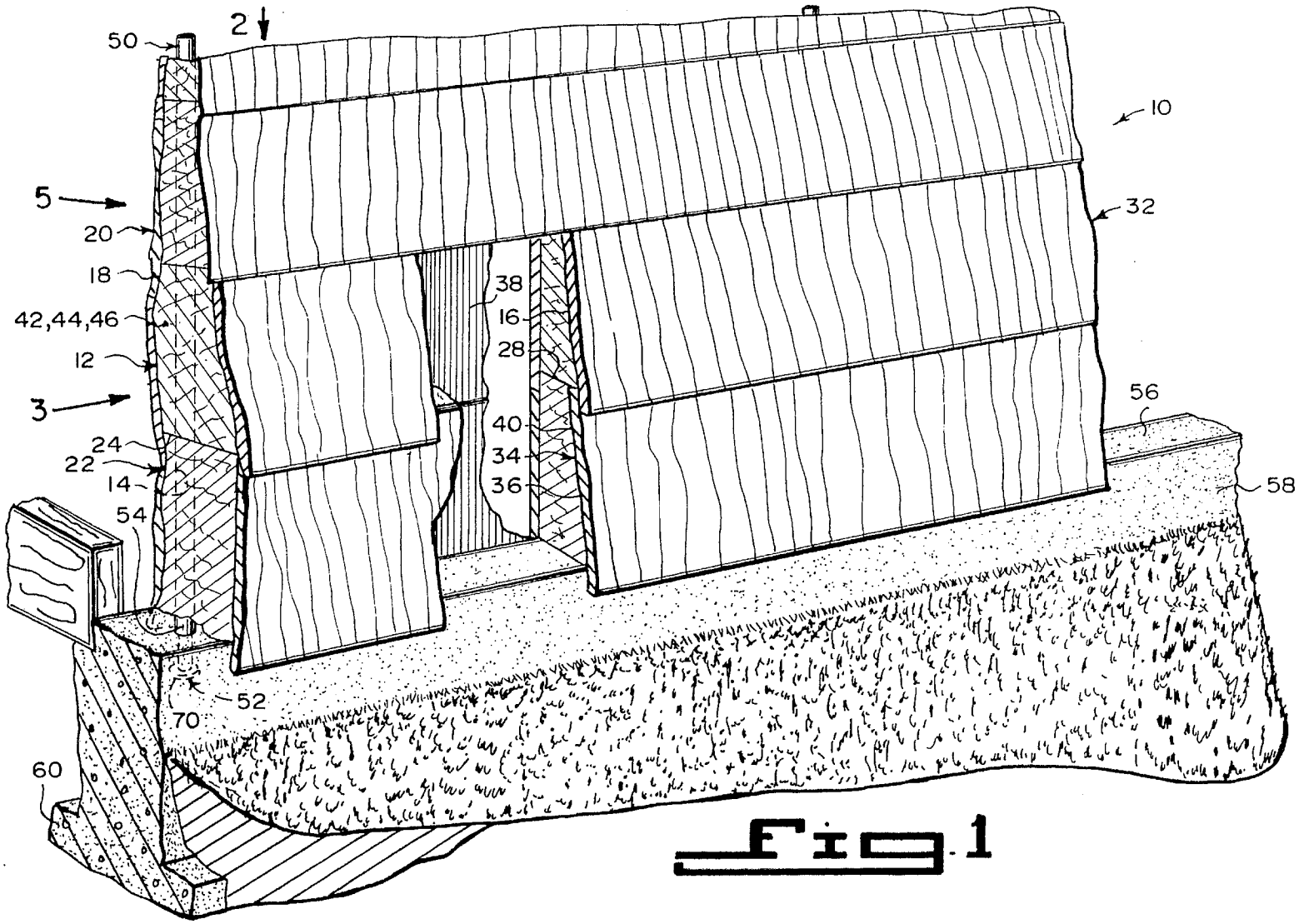
FIG. 1 is a front perspective view with parts broken away and in section of a wall constructed according to the instant invention.

Turning now descriptively to the drawings, in which similar reference characters denote similar elements throughout the several views, FIGS. 1 through 4 illustrate a modular wall panel assembly 10, comprising a plurality of generally rectangular shaped elongated horizontal slabs 12. Each slab 12 has a series of vertical through-going apertures 14, a sloping outwardly front surface 16 and a vertical rear surface 18. A plurality of wallboards 20 are provided. A substance 22 is for securing each wallboard 20 to the rear surface 18 of each slab 12. Each wallboard 20 will overhang a bottom end 24 and a rear end 26 of each slab 12 and will be set back from a top end 28 and a front end 30 of each slab 12. A plurality of siding sheets 32 are also provided. A substance 34 is for securing each siding sheet 32 to the front surface 16 of each slab 12. Each siding sheet 32 will overhang the bottom end 24 and the rear end 26 of each slab 12 and will be set back from the front end 30 of each slab 12. The slabs 12 can be interconnected one upon the other and side by side, with the through-going apertures 14 in the slabs 12 above in alignment with the through-going apertures 14 in the slabs 12 below. The wallboards 20 abut each other and the siding sheets 32 overlapping each other.

The first securing substance 22 is an adhesive material 36 applied between a back surface 36 of each wallboard 20 and the rear surface 18 of each slab 12. The second securing substance 34 is the same adhesive material 36 applied between a back surface 40 of each siding sheet 32 and the front surface 16 of each slab 12.

Figure 2:
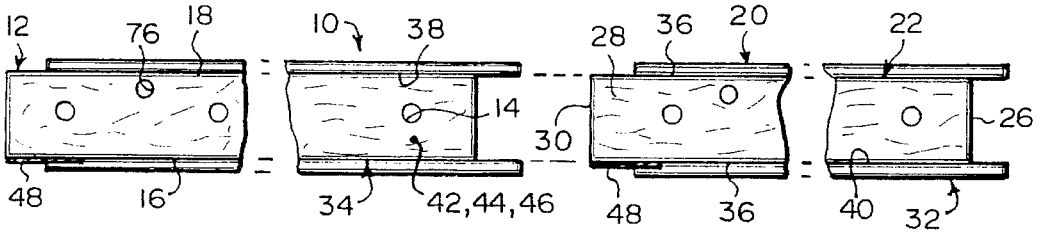
FIG. 2 is a top view taken in the direction of arrow 2 in FIG. 1, with parts broken away and exploded.

Each slab 12 is fabricated out of shredded cardboard and paper waste material 42, mixed with an adhesive material 44 and compressed into form. Each slab 12, also includes preservatives and waterproofing agents 46 added thereto, to make each slab 12 moisture and rot resistant. A flashing strip 48, as shown in FIG. 2, is secured between each front surface 16 at each front end 30 of each slab 12 and the back surface 40 of each siding sheet 32, to prevent any possibility of water entering between the abutting sides of the siding sheets 32.

The modular wall panel assembly 10 further includes a plurality of stay tubes 50. Each stay tube 50 extends through the aligned through-going apertures 14 in the slabs 12. Components 52 are for attaching lower ends 54 of the stay tubes 50, to a top end 56 of a foundation 58 resting on a footing 60. A facility 62 is for connecting upper ends 64 of the stay tubes 50 to a roof joist 66 below a roof rafter 68.

The lower attaching components 52 consist of a plurality of bolts 70 embedded into the top end 56 of the foundation 58 with threaded shanks of the bolts 70 extending upwardly and outwardly from the foundation. The stay tubes 50 have internal threads in the lower ends 54, to engage with the threaded shanks of the bolts 70.

The upper connecting facility 62 includes a plurality of U-shaped brackets 72. Each bracket 72 is swiveled onto the upper end 64 of each stay tube 50, so that the U-shaped brackets 72 can engage with the roof joists 66. At least one fastener 74 extends through one U-shaped bracket 72 and one roof joist 66.

Figure 5:
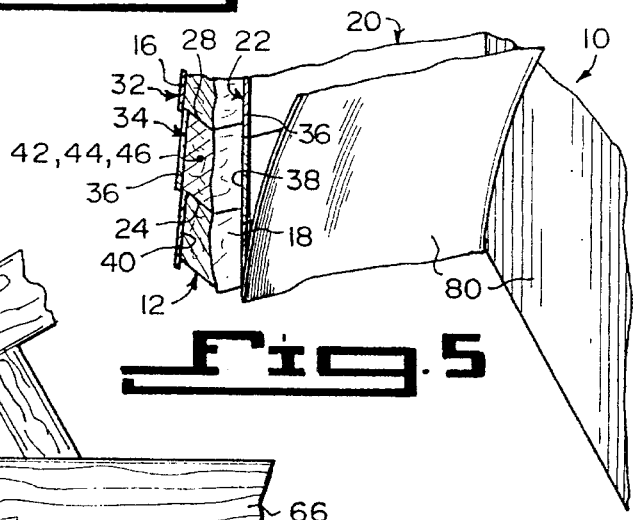
FIG. 5 is a rear perspective view of a corner, taken in the direction of arrow 5 in FIG. 1 with parts broken away and in section.
Figure 3:
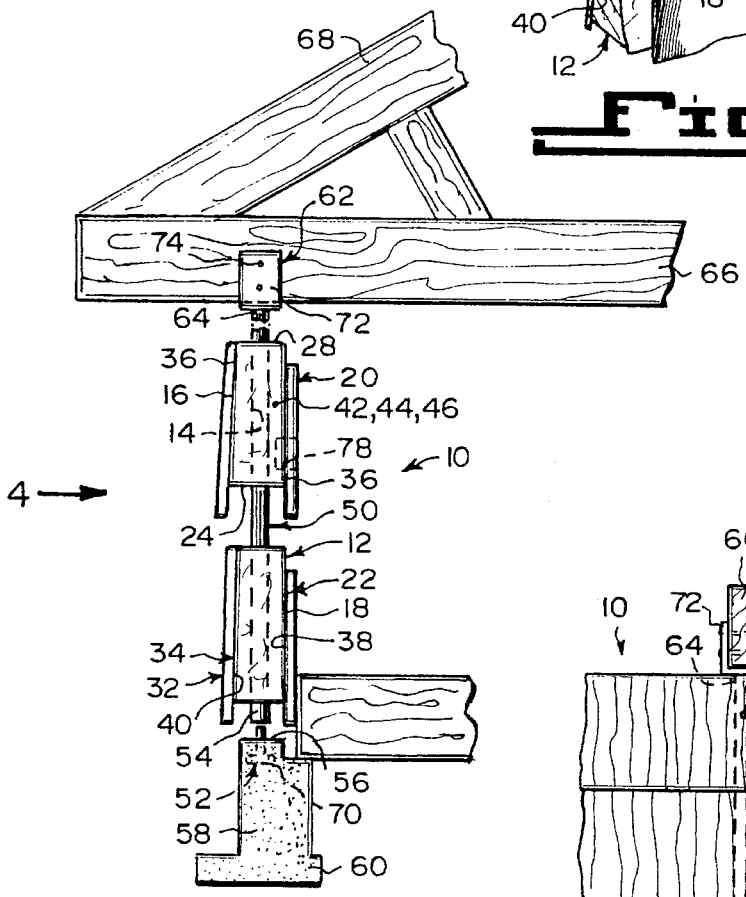
FIG. 3 is an end view partly exploded and broken away, taken in the direction of arrow 3 in FIG. 1.
Figure 4:
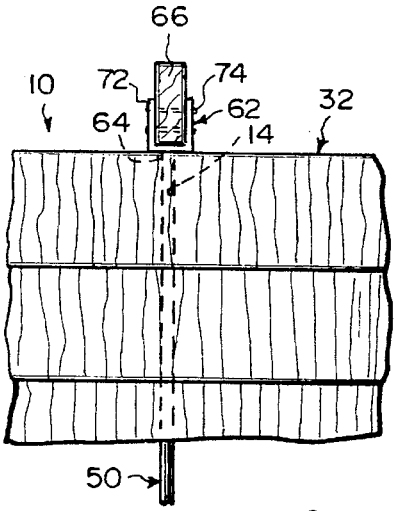
FIG. 4 is a front assembled view with parts broken away, taken in the direction of arrow 4 in FIG. 3.

Each slab 12 has additional vertical through-going apertures 76, as shown in FIG. 2, to accommodate electrical wiring running through. At least one cut out area 78 extending through the wallboard 20, as shown in FIG. 3, is for insertion of an electrical box, which connects to the electrical wiring. A heavy paintable wallpaper 80, as shown in FIG. 5, is glued onto the wallboards 20 for a smooth interior finish.

The wallboards 20 are made from at least one material selected from the group consisting of gypsum plaster encased in paper, compressed wood fibers and chips and any other kind of smooth surfaced hardboard. The siding sheets 32 are made from at least one material selected from the group consisting of fiberboard, vinyl, steel and wood. Each stay tube 50 is an elongated steel pipe.

LIST OF REFERENCE NUMBERS

10 modular wall panel assembly
12 slab
14 vertical through-going aperture in 12
16 sloping outwardly front surface of 12
18 vertical rear surface of 12
20 wallboard
22 first securing substance
24 bottom end of 12
26 rear end of 12
28 top end of 12
30 front end of 12
32 siding sheet
34 second securing substance
36 adhesive material for 22 and 34
38 back surface of 20
40 back surface of 32
42 shredded cardboard and paper waste material in 12
44 adhesive material in 12
46 preservatives and waterproofing agents in 12
48 flashing strip
50 stay tube
52 lower attaching component
54 top end of 50
56 top end of 58
58 foundation
60 footing
62 upper connecting facility
64 upper end of 50
66 roof joist
68 roof rafter
70 bolt of 52
72 U-shaped bracket of 62
74 fastener in 72
76 additional vertical through-going aperture in 12
78 cut out area in 12 and 20
80 heavy paintable wallpaper 80 on 20

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A modular wall panel assembly comprising:

a) a plurality of stacked generally rectangular shaped elongated horizontal slabs, each said slab having a series of vertical through-going apertures, a sloping outwardly front surface and a vertical rear surface lee;

b) a separate wallboard for each of said slabs;

c) first means for securing said wallboard to the rear surface of each said slab with each said wallboard overhanging a bottom edge of the slab and set back from the top edge of the slab;

d) a siding sheet for each of said slabs;

e) second means for securing said siding sheet to the front surface of each slab with each siding sheet overhanging the bottom edge of each slab, and a top edge of the secured siding sheet being flush with the top edge of the slab;

f) said slabs each being a module and stacked vertically with the vertical through-going apertures being aligned, the wallboard on each slab overlapping the slab immediately below, and the siding sheet for each slab overhanging a siding sheet on the slab immediately below; and g) stay means extending through said aligned vertical through-going apertures for providing foundation support the bottom of said stacked plurality of slabs and structural support on the top of said plurality of stacked slabs.

2. A modular wall panel assembly as recited in claim 1, wherein said first securing means is an adhesive material applied between a back surface of each said wallboard and said rear surface of each said slab.

3. A modular wall panel assembly as recited in claim 1, wherein said second securing means is an adhesive material applied between a back surface of each said siding sheet and said front surface of each said slab.

4. A modular wall panel assembly as recited in claim 1, wherein each said slab is fabricated out of shredded cardboard and paper waste material, mixed with an adhesive material and compressed into form.

5. A modular wall panel assembly as recited in claim 1, wherein each said slab includes preservatives and waterproofing agents added thereto, to make each said slab moisture and rot resistant.

6. A modular wall panel assembly as recited in claim 1, further including a flashing strip secured between each said top edge surface at each said front of each said slab and a back surface of each siding sheet to prevent any possibility of water entering between abutting sides of said siding sheets.

7. A modular wall panel assembly as recited in claim 1, further including:

a) said stay means comprising a plurality of stay tubes;

b) means for attaching lower ends of said stay tubes to a top end of a foundation resting on a footing; and c) means for connecting upper ends of said stay tubes to a roof joist below a roof rafter for the support thereof.

8. A modular wall panel assembly as recited in claim 7, wherein said lower attaching means includes:

a) a plurality of bolts embedded into the top end of the foundation with threaded shanks of said bolts extending upwardly and outwardly from the foundation; and b) said stay tubes having internal threads in the lower ends to engage with said threaded shanks of said bolts.

9. A modular wall panel assembly as recited in claim 7, wherein said upper connecting means includes:

a) a plurality of U-shaped brackets, with each said bracket swiveled onto the upper end of each said stay tube, so that said U-shaped brackets can engage with the roof joists; and b) at least one fastener extending through one said U-shaped bracket and one roof joist.

10. A modular wall panel assembly as recited in claim 1, further including each said slab having additional vertical through-going apertures to accommodate electrical wiring running through and at least one cut out area extending through said wallboard, for insertion of an electrical box, which connects to the electrical wiring.

11. A modular wall panel assembly as recited in claim 1, further including a heavy paintable wallpaper, which is glued onto said wallboards for a smooth interior finish.

12. A modular wall panel assembly as recited in claim 1, wherein said wallboards are made from at least one material selected from the group consisting of gypsum plaster encased in paper, compressed wood fibers and chips and any other kind of smooth surfaced hardboard.

13. A modular wall panel assembly as recited in claim 1, wherein said siding sheets are made from at least one material selected from the group consisting of fiberboard, vinyl, steel and wood.

14. A modular wall panel assembly as recited in claim 7, wherein each said stay tube is an elongated steel pipe.

* * * * *